United States Patent [19]

Stempfle

[11] Patent Number: 4,704,094

[45] Date of Patent: Nov. 3, 1987

[54] CATHODE RAY TUBE AND METHOD OF MANUFACTURE

[75] Inventor: Julius E. Stempfle, Portland, Oreg.

[73] Assignee: Tektronix, Inc., Beaverton, Oreg.

[21] Appl. No.: 806,903

[22] Filed: Dec. 9, 1985

[51] Int. Cl.[4] ..... H01J 9/00

[52] U.S. Cl. ..... 445/30; 445/37

[58] Field of Search ..... 445/30, 37, 45; 313/402, 403, 407, 408, 482

[56] References Cited

U.S. PATENT DOCUMENTS

| | | | |
|---|---|---|---|
| 2,842,696 | 7/1958 | Fischer-Colbrie | 445/37 X |
| 3,894,321 | 7/1975 | Moore | 445/37 X |
| 3,947,933 | 4/1976 | Banks | 445/47 |
| 4,069,567 | 1/1978 | Schwartz | 445/30 |
| 4,547,695 | 10/1985 | Rath | 313/406 |
| 4,605,879 | 8/1986 | Rath | 313/407 |

FOREIGN PATENT DOCUMENTS

| | | | |
|---|---|---|---|
| 1163495 | 9/1969 | United Kingdom | 445/30 |

*Primary Examiner*—Kenneth J. Ramsey

*Attorney, Agent, or Firm*—John D. Winkelman; John P. Dellett

[57] ABSTRACT

A high performance color cathode ray tube is manufactured by welding a shadow mask under very high tension to a metal ring brazed to the tube envelope. The shadow mask material has a high yield strength and a thermal coefficient of expansion near that of the ceramic ring portion of the envelope to which it is secured.

14 Claims, 6 Drawing Figures

FIG. 2
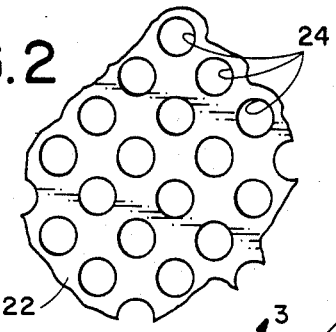
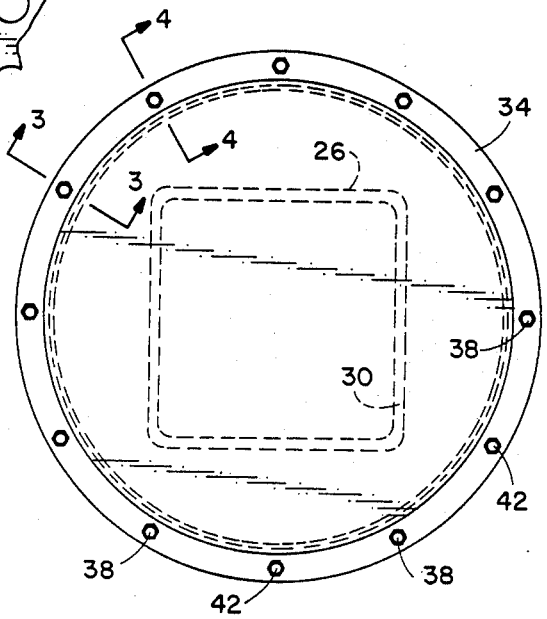
FIG. 6
FIG. 1
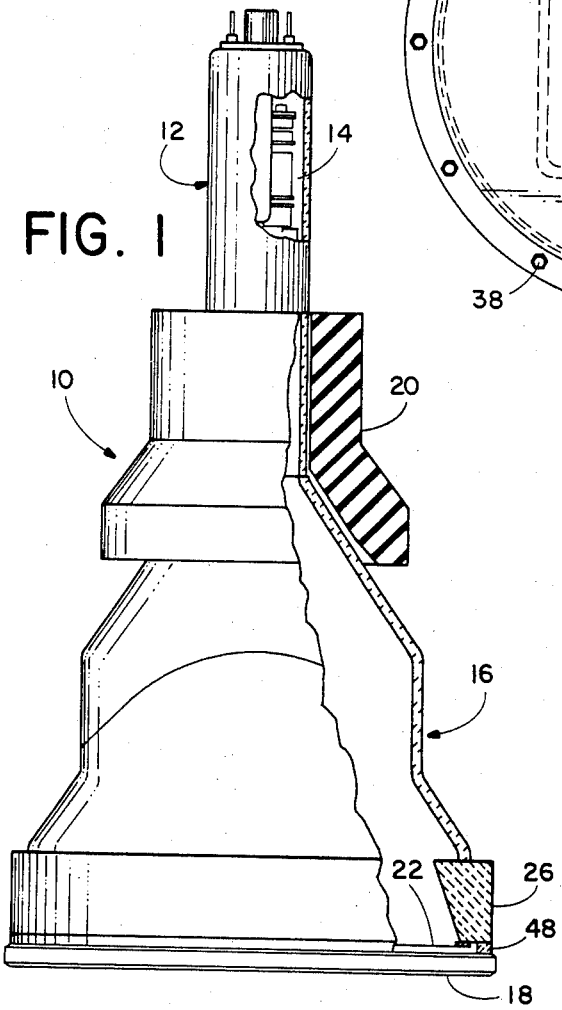

CATHODE RAY TUBE AND METHOD OF MANUFACTURE

BACKGROUND OF THE INVENTION

The present invention relates to a cathode ray tube and a method of manufacturing a cathode ray tube characterized by very high resolution and performance.

Cathode ray tubes for color reproduction typically employ a plurality of electron guns, each adapted to produce an electron beam directed toward phosphor screen elements of a given color. For example, the screen of the cathode ray tube may comprise a pattern of interspersed red, green and blue phosphor elements or dots each adapted for receiving excitation from one of three electron guns. Interposed between the phosphor screen and the electron gun structure is a so-called shadow mask comprising a thin metal sheet having a multiplicity of perforations positioned to pass the electron beam from one of the guns to the phosphor dots of a given color. For example, the array of apertures in the mask will allow the electron beam from the "red" gun to impinge only upon red phosphor dots while the non-apertured or blank part of the shadow mask casts a "shadow" over the green and blue dots. The "green" and "blue" guns are positioned in relation to the "red" gun, typically in triangular array, such that an electron beam from the "green" gun will strike only green phosphor dots and the electron beam from the "blue" gun will strike only blue phosphor dots.

The color resolution of the color tube is dependent upon the correct manufacture of the shadow mask and the correct alignment of the shadow mask relative to the phosphor elements or dots on the screen under operating conditions. A number of manufacturing methods have been utilized in attempting high color resolution. One method includes mechanical tensioning of a flat shadow mask relative to a heavy metal support frame that is then positioned inside the tube in spaced relation to the screen. However, the mechanical tension heretofore attained has been insufficient by itself to insure color purity and furthermore the metal frame can become displaced with respect to the screen as a result of heat or vibration. These mis-registration problems can be intolerable in very high resolution color tubes used for avionics purposes and the like.

Another method for emplacement of a shadow mask in a color cathode ray tube combines mechanical tensioning with applied heat. The shadow mask may be mechanically stretched and at the same time raised to a high temperature before being secured to a metal frame or to the cathode ray tube itself, while utilizing a shadow mask material having a coefficient of expansion substantially greater than that of the frame or tube to which it is to be attached. Under these circumstances, the shadow mask will contract more than the surrounding frame or envelope with cooling, resulting in higher mask tension and improved performance. As with the purely mechanical approach of the prior art, insufficient tension is applied to the shadow mask in this manner to insure color purity, particularly when the shadow mask may be subjected to high beam currents attendant to high brightness displays. The cathode ray tube, and particularly the shadow mask, often become heated during normal operation to relatively high temperatures, resulting in the reverse of the process under which the tension was achieved. I.e., the application of heat causes greater expansion of the shadow mask than the frame or tube and resultant deterioration in color resolution.

In U.S. Pat. No. 4,069,567 to Schwartz, a cathode ray tube construction is described wherein a shadow mask having a coefficient of thermal expansion substantially higher than the holder or envelope is heated to a higher temperature during manufacture than the holder or envelope whereby a higher tension is achieved after cool down than would result if both envelope and mask were heated to the same temperature. While resulting in higher room temperature tension, the mask in this case is still subject to undue relaxation of the mask when heated by high energy electrons. In any of the foregoing methods, the accuracy of shadow mask registration is insufficient to withstand high vibration effects encountered in aircraft, and to withstand high beam currents used for producing clearly visible color presentations under daylight conditions.

SUMMARY OF THE INVENTION

According to the present invention in a particular embodiment thereof, a shadow mask is secured under high tension directly to the envelope of a color cathode ray tube for accurate alignment with the cathode ray tube's phosphor screen and electron gun structure. Since a separate frame is not employed, the mask is less subject to relative movement or vibration with respect to the cathode ray tube screen. The material from which the shadow mask is manufactured has high yield strength and a coefficient of thermal expansion near that of the envelope to which it is attached under high tension whereby effects due to misregistration caused by heat during operation are minimized or eliminated. Thus, the mask doesn't expand to a substantially greater degree than the envelope when both are heated.

The shadow mask is placed under mechanical tension on the order of 40,000 to 80,000 psi before being secured to the envelope and is preferably secured thereto at room temperature by welding to a metal ring brazed to the envelope. High total tension raises the natural frequency of mask vibration well above minimum requirements.

The resulting tube is capable of operating at very high beam currents and correspondingly very high brightness levels and can undergo severe vibration without loss of color purity.

It is accordingly an object of the present invention to provide an improved cathode ray tube capable of very high resolution color reproduction.

It is another object of the present invention to provide an improved color cathode ray tube which is capable of accurate color reproduction despite the presence of vibration and high beam currents.

It is another object of the present invention to provide an improved color cathode ray tube capable of operating at high brightness levels.

It is another object of the present invention to provide an improved shadow mask for a color cathode ray tube which is secured directly to the tube envelope under high tension conditions.

The subject matter of the present invention is particularly pointed out and distinctly claimed in the concluding portion of this specification. However, both the organization and method of operation of the present invention, together with further advantages and objects thereof, may best be understood by reference to the following description taken in connection with the accompanying drawings wherein like reference characters refer to like elements.

DRAWINGS

FIG. 1 is a side view, partially broken away, of a cathode-ray-tube according to the present invention, FIG. 2 is a greatly enlarged plan view of a portion of a shadow mask utilized in the FIG. 1 tube, FIG. 3 is an exploded, cross sectional view illustrating a method of manufacture including placement of the FIG. 2 shadow mask within a cathode-ray-tube structure, FIGS. 4 and 5 are cross sectional views further illustrative of the aforementioned method, and FIG. 6 is a plan view of tensioning apparatus utilized according to the method of the present invention.

DETAILED DESCRIPTION

Figure 3:
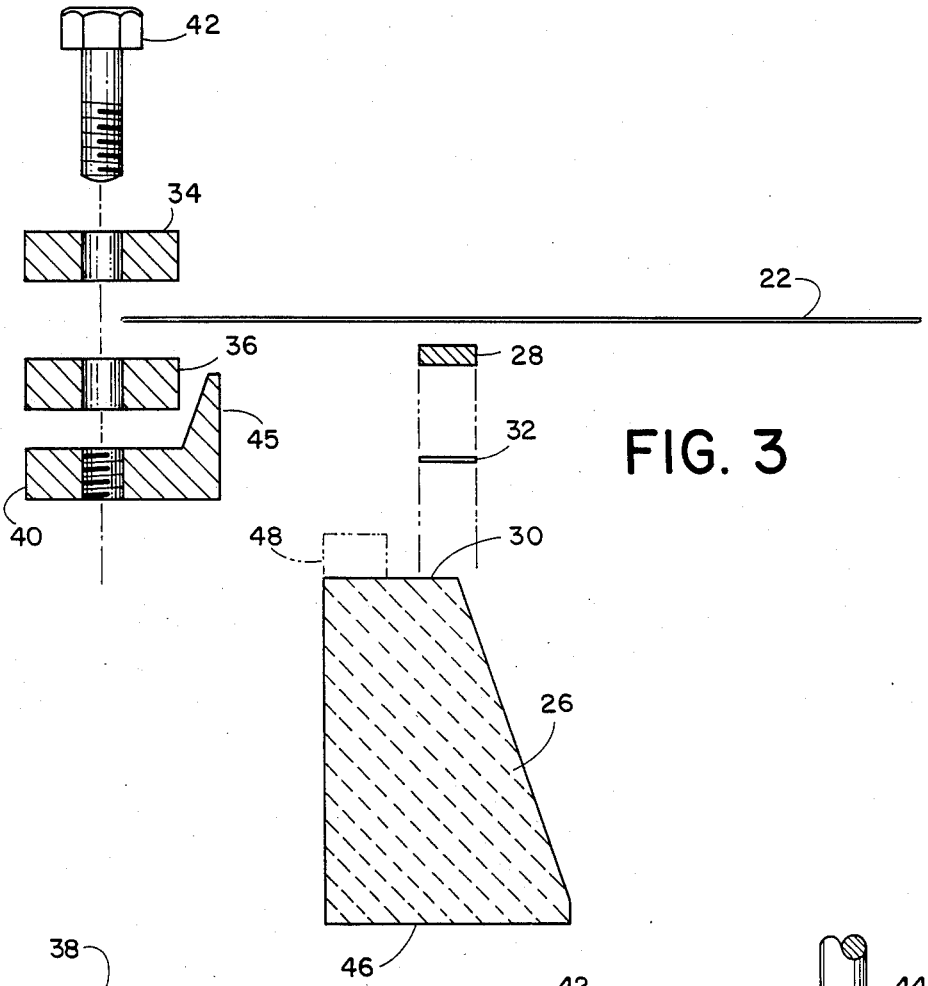

Referring to the drawings and particularly to FIG. 1, a cathode-ray-tube 10 according to the present invention comprises a glass or ceramic envelope having a neck portion 12 housing electron gun structure 14, and a funnel portion 16 which terminates in a faceplate 18 having a phosphor screen provided with a multiplicity of phosphor color elements or dots (not shown) disposed in juxtaposition with the electron gun structure 14. The structure 14 comprises three electron guns disposed in either delta or in-line configuration and adapted for generating three electron beams, each of which can be aimed at phosphor elements of one particular color on the screen. Deflection yoke 20 may be connected to conventional television sweep circuitry for directing the electron beams in raster fashion, or the beams may be similarly deflected in any desired pattern over the screen of the tube.

Disposed between the cathode-ray-tube gun structure 14 and the faceplate 18 is a shadow mask 22 having a multiplicity of apertures 24 (as shown in FIG. 2), each of which is configured to pass an electron beam from the guns of structure 14 to corresponding color phosphor elements on faceplate 18. The apertures 24 in shadow mask 22 are arrayed in a well-known fashion such that the beam from the electron gun corresponding to one "color" can strike only phosphor elements on the screen of the same color, while shadow mask 22 blocks or casts a shadow relative to the phosphor elements of any other color. The electron guns of structure 14 and the phosphor elements on the screen are typically disposed in triangular pattern so that the same shadow mask is efficacious in masking the phosphor elements of all colors from electron beams of other than the one of the same "color". The apertures 24 have a diameter on the order of 0.1 mm and a pitch or center-to-center spacing of about 0.2 mm. The apertures constitute about 25% of the mask's surface area such that the electron beam impinges upon the mask itself for the majority of the time, resulting in heating of the mask.

The shadow mask according to the present invention is formed of a high temperature yield strength metal placed under high mechanical tension, on the order of between 40,000 and 80,000 psi, and is secured to a portion of the tube envelope itself rather than being secured to a heavy frame for positioning within the tube. The tension is produced by mechanical means, preferably at room temperature, or within a range approximately defined by temperatures at or below the usual operating temperature of the tube, while the coefficient of thermal expansion of the material from which the shadow mask is made is selected to be very close to that of the envelope portion to which it is attached. Inasmuch as the shadow mask is preferably secured to the envelope at room temperature, it will be seen there is no dependence upon differential contraction of the mask relative to its mounting for tensioning. Rather, the expansion and contraction of shadow mask and envelope are fairly well matched over a wide temperature range. Thus, the prior art problem is avoided wherein tensioning the shadow mask produced a shadow mask more subject to de-tensioning when high operating temperatures were encountered. Consequently misregistration of an electron beam with the phosphor elements is much less likely to result during tube operation.

The metal shadow mask is suitably formed from a thin sheet of nickel-chromium-titanium alloy. In a particular embodiment according to the present invention, the metal shadow mask had a thickness of one one-thousandth of an inch and was rolled from a product known as Ni-Span-C-902 manufactured by Huntington Alloys, Inc., Huntington, W. Va. The limiting chemical composition of the latter alloy, as provided by the manufacturer, is given in the following table:

| Limiting Chemical Composition, % | |
|---|---|
| Nickel (plus cobalt) | 41.0 to 43.50 |
| Chromium | 4.90 to 5.75 |
| Titanium | 2.20 to 2.75 |
| Aluminum | 0.30 to 0.80 |
| Carbon | 0.06 max. |
| Manganese | 0.80 max. |
| Silicon | 1.00 max |
| Sulfur | 0.04 max. |
| Phosphorus | 0.04 max. |
| Iron | Remainder |

The above metal has the advantage of high temperature yield strength allowing high mechanical tension and a relatively constant modulus of elasticity. The alloy also has a coefficient of thermal expansion near that of the envelope portion to which it is to be attached, i.e., the coefficient of expansion of this metal alloy at room temperature is slightly over $8\times10^{-6}$ inches/inch/degree C. and is approximately $9.9\times10^{-6}$ inches/inch/degree C. at 250° C., the latter representing a not uncommon tube operating temperature. At approximately 450° C., which may be reached during manufacture of the tube after emplacement of the shadow mask, the coefficient of expansion of the above-mentioned material is near $10.5\times10^{-6}$ inches/inch/degree C. Compared with the coefficient of expansion for envelope material, e.g. approximately $9.6\times10^{-6}$ inches/inch/degree C. for ceramic and approximately $9.35\times10^{-6}$ inches/inch/degree C. for glass, it will be seen the coefficient of thermal expansion of the shadow mask metal is nearly the same. In a specific embodiment, the shadow mask was secured to a Forsterite ceramic ring 26 (in FIG. 1) comprising part of the funnel portion of the tube and having a cofficient of thermal expansion of $9.6\times10^{-6}$ inches/inch/degree C. It is preferred the thermal coefficient of expansion of the shadow mask be within about 18% (i.e. 82% to 118%) of the thermal coefficient of expansion of the envelope portion to which it is secured. Ceramic ring 26 has a larger radial thickness than the rest of the funnel portion to provide strength in supporting the shadow mask, but its inside dimensions become larger toward the faceplate to pass the trajectory of the electron beams to the widest possible area.

The above-mentioned alloy material for manufacture of the shadow mask has been found very suitable, but it is understood other metals having sufficient strength and a coefficient of thermal expansion near that of the envelope portion can be substituted. For example, the shadow mask may be formed from a titanium alloy such as one including about 15% vanadium and a small amount of chromium.

Figure 5:
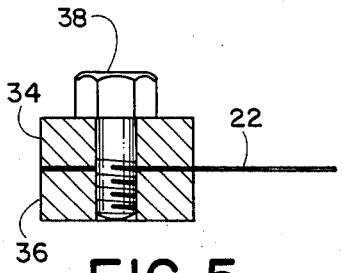

Referring again to the drawings, FIGS. 3 through 6 are illustrative of a method according to the present invention of securing the shadow mask 22 to ceramic envelope ring portion 26. First, a titanium metal ring 28 is adhered to the outer surface 30 of ceramic ring 26, preferably by brazing. In the particular embodiment, an intermediate foil ring 32 of silver braze material, for example a ring formed from a product known as Cusil manufactured by Englehart, is placed on surface 30, with titanium ring 28 thereover. The combination is weighted and placed in a vacuum furnace which is brought up slowly to a temperature for brazing the titanium ring to the ceramic. The combination is retained at the brazing temperature for a short time, e.g. 5 minutes, whereby titanium contained in the silver braze material, or titanium from ring 28, can migrate onto the ceramic ring 26 through the one to two thousandths inch thick foil 32 of molten braze material to "wet" the ceramic. After the titanium ring 28 is secured to ceramic ring 26, the titanium ring top surface is suitably ground so that it is completely flat. Then the shadow mask 22, perforated by a conventional photoetching process to provide the configuration illustrated in FIG. 2, is clamped between first and second flat metal rings 34 and 36 of approximately equal size and having an inside diameter greater than the outside diagonal dimension of ceramic ring 26. First bolts 38, passing through ring 34, threadably engage ring 36 and are drawn up tightly to secure the flat shadow mask between the rings as illustrated in FIG. 5. A third ring 40 is positioned below ring 36, as illustrated in FIG. 3, and bolts 42 (intermediate bolts 38), extending through apertures in rings 34 and 36, are threadably engaged with ring 40 for drawing ring 40 toward the other rings, e.g., to the position depicted in FIG. 4. Ring 40 is provided at its inner diameter with a cylindrical axial flange 45 disposed inwardly of rings 34 and 36 but outwardly of ceramic ring 26 for bearing against the underside of mask 22. When ring 40 is drawn up, the mask 22 can be placed under considerable mechanical tension, suitably in a range of 40,000 to 80,000 psi and preferably from 50,000 to 60,000 psi. Undesirable resonant vibration is avoided since high total tension raises the natural frequency of mask vibration well above a 1,000 Hz. minimum requirement.

Figure 4:
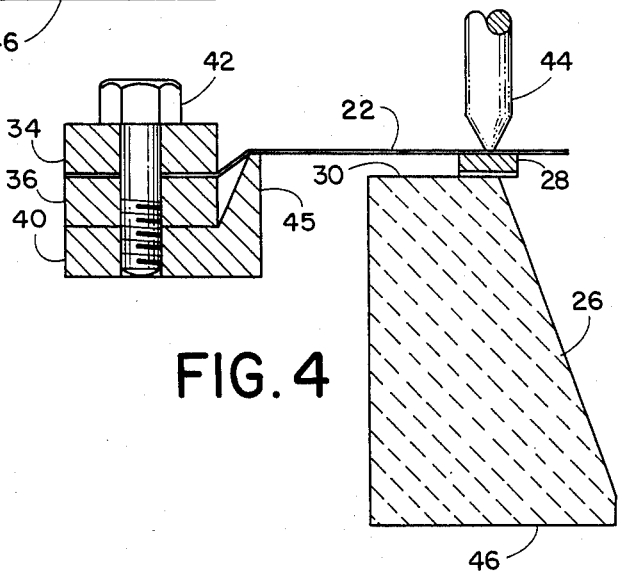

With the shadow mask tensioned in this manner, the assemblage of the shadow mask together with rings 34, 36 and 40 is placed over ceramic ring 26 as illustrated in FIGS. 4 and 6, and the shadow mask is spot welded to ring 28 by energizing electrodes such as electrode 44 illustrated in FIG. 4. A pair of such electrodes is suitably utilized in side-by-side arrangement whereby the welding current passes through one electrode, through the mask 22 and ring 28, and then through the remaining electrode. The welding is accomplished so that spot welds are approximately 50 to 60 thousandths of an inch apart. After the welding is finished, the shadow mask 22 can be severed around the outside edge of ring 28. It will, of course, be realized that the pattern of apertures for the shadow mask as illustrated in FIG. 2 is positioned to be within the inside dimensions of ring 28.

After completion of the emplacement of the shadow mask on ceramic ring 26, a ceramic ring 48 is secured as by fritting onto surface 30 of ring 26, outside the shadow mask and ring 28. Then faceplate 18, on which the phosphor screen is provided, is secured to ceramic ring 48. The surface 46 of ceramic ring 26 is fritted onto the remainder of funnel portion 16.

Titanium ring 28 has substantially the same coefficient of thermal expansion as the Forsterite ceramic ring 26, and together with ring 26 forms a structure which is strong in compression for supporting mask 22, a structure which can be welded to, and one which is an integral part of the tube envelope.

Although methods other than welding may be used to secure the shadow mask in place, welding is preferred inasmuch as it enables the shadow mask to be more securely fastened to the ring 26 under appreciable tension, i.e., welding provides greater bonding strength. Furthermore, the aforementioned brazing and welding method reduces the required surface bond area, and the position and placement of the shadow mask is accurately controllable. Also, welding is simpler and less time consuming, can be accomplished at room temperature, and does not interrupt the high voltage connection path to the shadow mask.

The tensioning frame comprising rings 34, 36 and 40 has been heretofore described, for the purpose of welding a shadow mask onto a separate frame adapted to be positioned within a cathode ray tube, in European Patent Office Publication No. 0121628.

The present invention has been found to bring about a dramatic increase in the beam current capability of a tube, which as a direct consequence dramatically increases picture brightness. The beam currents can be several times the beam currents heretofore possible. Even though the high beam currents may cause an appreciable temperature rise during operation of the tube, nevertheless ultra high tension on the order of 60,000 psi exerted on the shadow mask does not permit the mask to loosen or buckle as would be the case if prior art methods were used. Moreover, the shadow mask can withstand more heat without its tension relaxing below levels required for vibration isolation. Since the coefficient of thermal expansion of the shadow mask is nearly the same as that of the envelope to which it is attached, the undesirable effect heretofore encountered in the art of the shadow mask expanding at a greater rate with increase in temperature than the holder to which it is fastened is to a considerable extent avoided. The shadow mask is also maintained in accurate juxtaposition with respect to the color screen inasmuch as it is secured directly to the tube envelope and not to a separate internal frame that can move relative to the screen as a result of vibration or temperature change.

In accordance with the preferred embodiment, the highly tensioned shadow mask, substantially immovable with respect to the tube envelope, is implemented by mechanically tensioning the mask and then welding the shadow mask directly to a metallic ring brazed onto the tube envelope. The shadow mask is thus securely bonded under high tension to the tube structure which carries the phosphor pattern for maintaining registration accuracy despite temperature change occasioned by a bright image and despite vibration.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. The method of manufacturing a cathode ray tube provided with a multiple color gun structure housed within an envelope, comprising the steps of:

mechanically tensioning a metal shadow mask with respect to a funnel portion of said envelope, and securing said shadow mask under tension to said portion of said envelope at a temperature in the range of normal operating temperatures of said color cathode ray tube or below, including bonding said shadow mask to said envelope portion substantially along the entire periphery of said shadow mask to provide a unitary structure with said envelope portion, wherein said shadow mask is tensioned within a range of 40,000 to 80,000 psi and wherein the shadow mask has a yield strength greater than the tension applied substantially to retain said tension, and wherein said shadow mask is formed of a material having a coefficient of expansion within about 18% of the temperature coefficient of expansion of said envelope portion.

2. The method according to claim 1 wherein the coefficient of thermal expansion of said shadow mask is within a range of about 82% to 118% of the coefficient of expansion of said envelope portion.

3. The method according to claim 1 wherein said envelope portion is formed of ceramic material.

4. The method according to claim 1 wherein said shadow mask is formed from a titamium alloy.

5. The method according to claim 1 wherein said shadow mask is formed from nickel-chromium-titanium alloy.

6. The method according to claim 5 wherein said envelope portion is formed of Forsterite.

7. The method according to claim 1 wherein said shadow mask is formed from titanium-vanadium-chromium alloy.

8. The method according to claim 1 wherein said envelope portion is formed of glass.

9. The method according to claim 1 wherein said shadow mask is tensioned by clamping the same between a first ring and a second ring and drawing a third ring toward the first two rings wherein said third ring is provided with an axially cylindrical flange directed toward said shadow mask within the inside diameter of the first two rings..

10. The method of manufacturing a color cathode ray tube provided with a multiple gun structure and an envelope housing the same, said method comprising:

brazing a metal ring to a ring-shaped portion of said envelope adapted for orientation generally toward the phosphor screen end of said cathode ray tube, and tensioning a metal shadow mask member by providing radial tensioning force thereto, and welding said tensioned shadow mask to said metallic ring, wherein said shadow mask is formed of a material having a coefficient of thermal expansion within about 18% of the temperature coefficient of expansion of said envelope portion.

11. The method according to claim 10 wherein said shadow mask is tensioned to between 40,000 and 80,000 psi, and the shadow mask material has a yield strength higher than the tension applied.

12. The method of manufacturing a cathode ray tube provided wiht a multiple color gun structure housed within an envelope, comprising the steps of:

brazing a metal ring to a funnel portion of said envelope, mechanically tensioning a metal shadow mask with respect to said funnel portion of said envelope, and securing said shadow mask under tension to said portion of said envelope at a temperature in the range of normal operating temperature of said color cathode ray tube or below, by elding said shadow mask to said metal ring while said shadow mask is under tension, wherein said shadow mask is formed of a material having a coefficient of expansion within about 18% of the temperature coefficient of expansion of said envelope portion.

13. The method of manufacturing a cathode ray tube provided with a multiple color gun structure housed within an envelope, comprising the steps of:

bonding a metal ring to a funnel portion of said envelope to provide a unitary structure therewith, mechanically tensioning a metal shadow mask with respect to said funnel portion of said envelope, and securing said shadow mask under tension to said portion of said envelope at a temperature in the range of normal operating temperatures of said color cathode ray tube or below, by bonding said shadow mask to said metal ring to provide a unitary structure with said ring while said shadow mask is under tension, wherein said shadow mask is formed of a material having a coefficient of expansion within about 18% of the temperature coefficient of expansion of said envelope portion.

14. The method according to claim 13 wherein said shadow mask is tensioned to within a range of 40,000 to 80,000 psi and wherein the metal from which said shadow mask is formed has a yield strength greater than the tension applied.

* * * * *